US008298001B2

(12) United States Patent
Ashibu et al.

(10) Patent No.: US 8,298,001 B2
(45) Date of Patent: Oct. 30, 2012

(54) BOARD CONNECTOR PROVIDED WITH AN ACTUATOR INTEGRAL WITH A BEAM PORTION OF A CONTACT

(75) Inventors: Kenta Ashibu, Tokyo (JP); Kanji Inoue, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 13/136,975

(22) Filed: Aug. 16, 2011

(65) Prior Publication Data

US 2012/0100736 A1 Apr. 26, 2012

(30) Foreign Application Priority Data

Oct. 20, 2010 (JP) ..... 2010-235684

(51) Int. Cl.
*H01R 12/24* (2006.01)

(52) U.S. Cl. ..... 439/495; 439/328

(58) Field of Classification Search ..... 439/495, 439/493, 492, 260, 328, 635
See application file for complete search history.

(56) References Cited

U.S. PATENT DOCUMENTS

| | | | | |
|---|---|---|---|---|
| 3,858,957 | A * | 1/1975 | Harwood et al. | 439/59 |
| 6,431,897 | B1 * | 8/2002 | Hashiguchi et al. | 439/267 |
| 7,270,567 | B2 * | 9/2007 | Inoue | 439/495 |
| 7,422,472 | B2 * | 9/2008 | Hashiguchi et al. | 439/495 |
| 8,075,328 | B2 * | 12/2011 | Ashibu | 439/260 |
| 2007/0066127 | A1 * | 3/2007 | Inoue | 439/495 |
| 2008/0050958 | A1 * | 2/2008 | Hashiguchi et al. | 439/312 |
| 2008/0050966 | A1 * | 2/2008 | Hashiguchi et al. | 439/312 |
| 2011/0244709 | A1 * | 10/2011 | Ashibu | 439/372 |

FOREIGN PATENT DOCUMENTS

| | | |
|---|---|---|
| JP | 2002-270292 | 9/2002 |
| JP | 2004-039479 | 2/2004 |
| JP | 2006-351288 | 12/2006 |
| JP | 2010-061927 | 3/2010 |
| JP | 2010-225448 | 10/2010 |

OTHER PUBLICATIONS

English translation of relevant parts of Japanese Office Action dated Dec. 15, 2010 in Japanese Application No. 2010-235684.
English translation of relevant parts of Japanese Office Action dated Apr. 27, 2011 in Japanese Application No. 2010-235684.

* cited by examiner

*Primary Examiner* — Tulsidas C Patel
*Assistant Examiner* — Phuongchi Nguyen
(74) *Attorney, Agent, or Firm* — Collard & Roe, P.C.

(57) ABSTRACT

For connecting a board member inserted in a board insertion direction, a board connector includes a contact with a first and a second beam portion, a housing holding the contact, and an actuator integral with the first beam portion. The first and the second beam portions include a first and a second clamping portion, respectively, for clamping therebetween the board member. The actuator includes an effort point portion formed forward with respect to the first clamping portion in the board insertion direction. When an operator inserts the board member into the board connector, the board member pushes and moves the effort point portion.

20 Claims, 12 Drawing Sheets

BOARD CONNECTOR PROVIDED WITH AN ACTUATOR INTEGRAL WITH A BEAM PORTION OF A CONTACT

This application is based upon and claims the benefit of priority from Japanese patent application No. 2010-235684, filed on Oct. 20, 2010, the disclosure of which is incorporated herein in its entirety by reference.

TECHNICAL FIELD

This invention relates to a connector and, in particular, to a board connector for connecting a plate-like connecting object or board, such as a FPC (Flexible Printed Circuit) and a FFC (Flexible Flat Cable).

BACKGROUND OF THE INVENTION

Japanese Unexamined Patent Application Publication (JP-A) No. 2006-351288 (Patent Document 1) discloses a connector having a housing and a plurality of contacts supported by the housing. Each of the contacts has a first contacting portion and a second contacting portion. The first contacting portion and the second contacting portion are opposed to each other in a non-contacting state and, when a connecting object is inserted between opposed surfaces thereof, are displaced by the connecting object to be brought into elastic contact with both surfaces of the connecting object.

Japanese Unexamined Patent Application Publication (JP-A) No. 2004-39479 (Patent Document 2) discloses a connector apparatus for a flexible printed wiring board. The connector apparatus for a flexible printed wiring board of Patent Document 2 has a housing, a plurality of contact members arranged in parallel to one another in the housing, and an actuator to be operated. Each of the contact members has an upper contact part and a lower contact part opposed thereto. The upper contact part and the lower contact part are spaced from each other to the extent that a flexible printed wiring board to be connected can be inserted therebetween, and are designed to clamp the flexible printed wiring board with a predetermined contacting pressure by operating the actuator.

SUMMARY OF THE INVENTION

However, in the connector of Patent Document 1, a pad of the connecting object is easily peeled on being inserted in the connector as will later be described in detail. Further, depending on a thickness of the connecting object, it becomes difficult to insert the connecting object between the first contacting portion and the second contacting portion.

In the connector apparatus for a flexible printed wiring board of Patent Document 2, a workload on mounting the flexible printed wiring board is large as will later be described in detail. Further, various components, including the actuator, may be subjected to an excessive force during an operation, resulting in a breakage of those components. Furthermore, when the connector apparatus is designed in a small size, it is difficult to manually operate the actuator by operator's fingers of ordinary sizes. As a consequence, an operation of mounting the flexible printed wiring board becomes further difficult.

It is therefore an exemplary object of the present invention to provide a board connector, which is improved or decreased with problems during insertion of a board member to the board connector.

Other objects of the present invention will become clear as the description proceeds.

According to an exemplary aspect of the present invention, there is provided a board connector for connecting a board member inserted thereto in a board insertion direction. The board connector comprises a contact which comprises a first and a second beam portion, a housing which holds the contact, and an actuator which is integral with the first beam portion. In the board connector, the first and the second beam portions comprise a first and a second clamping portion, respectively, for clamping therebetween the board member, and the actuator comprises an effort point portion which is formed forward with respect to the first clamping portion in the board insertion direction and which is pushed and moved by the board member when the board member is inserted into the board connector.

It is noted here that the term "integral" mentioned in the present invention means that a plurality of members are integrally operated, and is not restricted to a meaning that a plurality of members are integrally molded. For example, the term "Integral" includes that a plurality of members separately and independently molded are fitted to one another to be integrally operated.

DESCRIPTION OF THE EXEMPLARY EMBODIMENT

In order to facilitate an understanding of the present invention, related techniques will be first described with reference to FIGS. 1 to 3.

Figure 1:
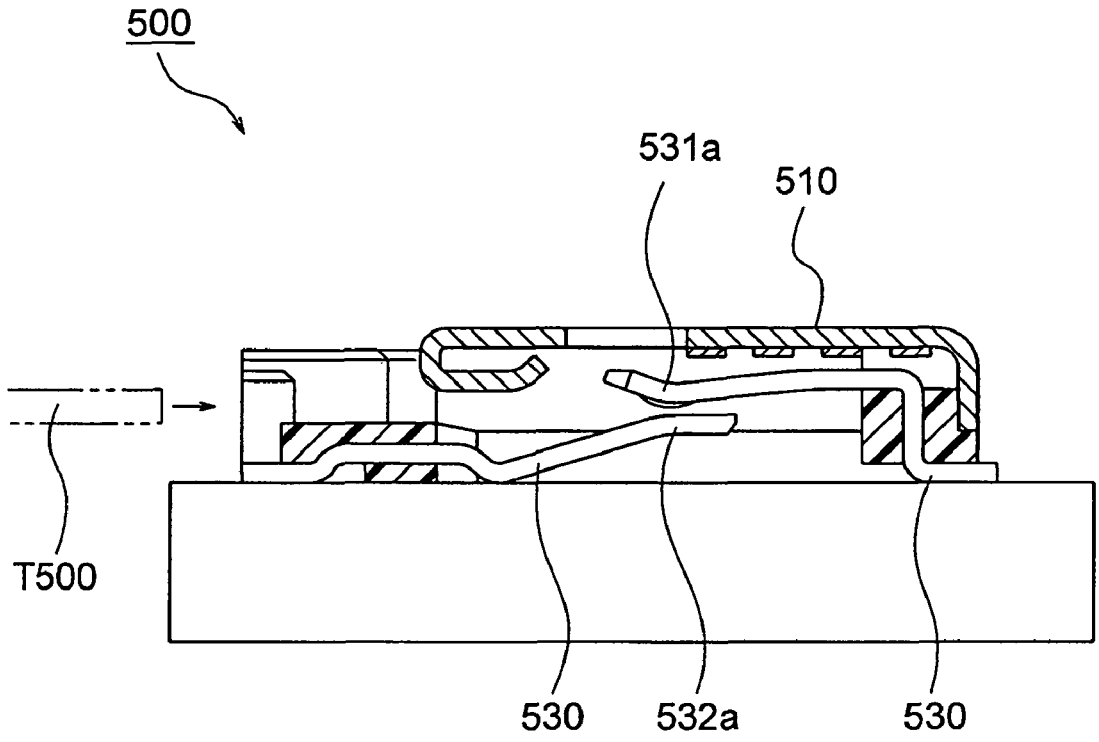
FIG. 1 PRIOR ART
FIG. 1 is a sectional view showing a conventional connector.

FIG. 1 shows a connector 500 described in Patent Document 1 mentioned above. The connector 500 has a housing 510 and a plurality of contacts 530 supported by the housing 510. Each of the contacts 530 has a first contacting portion 531*a* and a second contacting portion 532*a*. The first contacting portion 531*a* and the second contacting portion 532*a* are opposed to each other in a non-contacting state and, when a connecting object T500, such as a flexible printed wiring board, is inserted between opposed surfaces of the first and the second contacting portions 531*a* and 532*a*, are displaced by the connecting object T500 to be brought into elastic contact with both sides of the connecting object T500. The opposed surfaces of the first contacting portion 531*a* and the second contacting portion 532*a* are formed in a concave shape and a convex shape with a substantially constant space kept therebetween in a displacement direction.

In the connector 500 in FIG. 1, if the connecting object T500 to be inserted between the first contacting portion 531*a* and the second contacting portion 532*a* of the contact 530 is manufactured thicker within a tolerance range, surfaces of the connecting object T500 are rubbed with the first contacting portion 531*a* and the second contacting portion 532*a* during insertion of the connecting object T500. Therefore, a pad of the connecting object T500 is easily peeled because an end portion of the connecting object T500 is a cutting surface. Further, depending on a thickness of the connecting object T500, it becomes difficult to insert the connecting object T500 between the first contacting portion 531*a* and the second contacting portion 532*a*.

Figure 2:
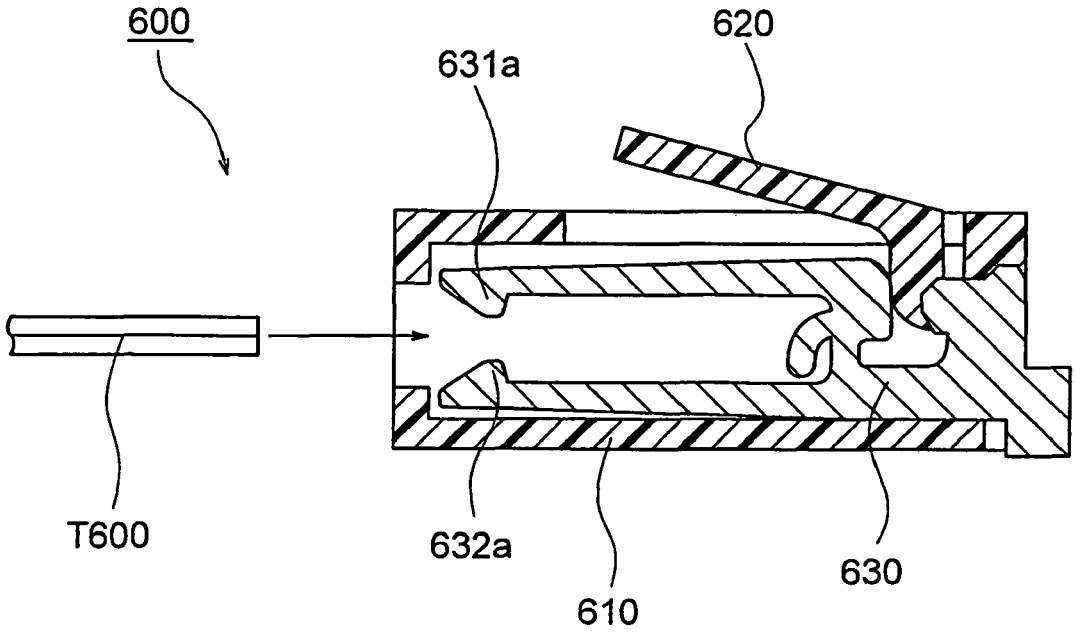
FIG. 2 PRIOR ART
FIG. 2 is a sectional view for describing a conventional connector apparatus in a state before a flexible printed wiring board is mounted thereto.
Figure 3:
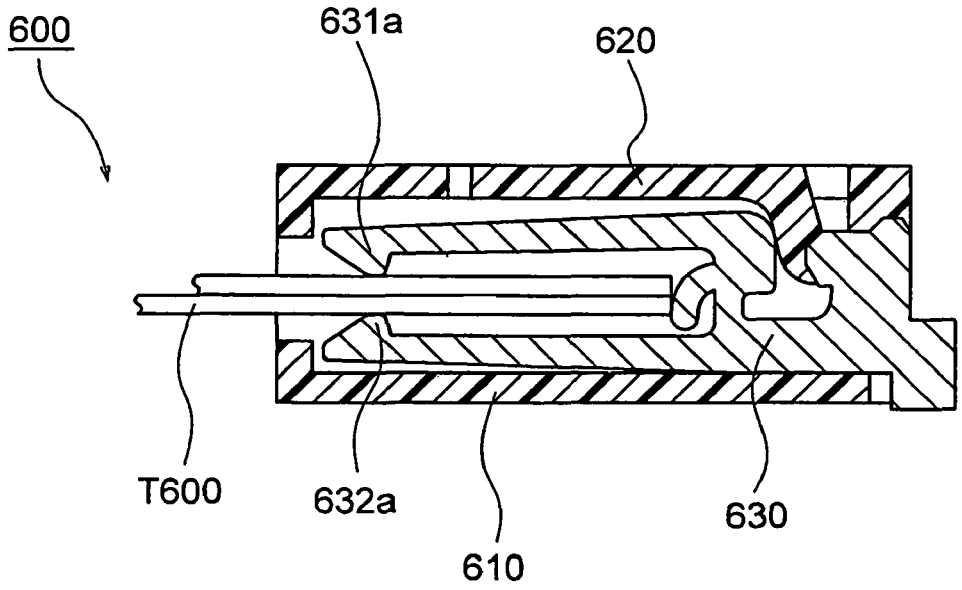
FIG. 3 PRIOR ART
FIG. 3 is a sectional view for describing the conventional connector apparatus in a state where mounting of the flexible printed wiring board is completed.

FIGS. 2 and 3 show a connector apparatus 600 for a flexible printed wiring board described in Patent Document 2 mentioned above. The connector apparatus 600 has a housing 610, a plurality of contact members 630 arranged in parallel to one another in the housing 610, and an actuator 620 to be operated. Each of the contact members 630 has an upper contact part 631*a* and a lower contact part 632*a* opposed thereto. The upper contact part 631*a* and the lower contact part 632*a* are spaced from each other to the extent that a flexible printed wiring board T600 can be inserted therebetween, and are designed to clamp the flexible printed wiring board T600 with a predetermined contacting pressure by operating the actuator 620.

In the connector apparatus 600 in FIGS. 2 and 3, mounting the flexible printed wiring board T600 requires two operation steps of inserting the flexible printed wiring board T600 and of operating the actuator 620. Therefore, a workload on mounting of the flexible printed wiring board T600 is large. Further, since the actuator 620 is manually operated, various components, including the actuator 620, may be subjected to an excessive force, resulting in a breakage of those components. Furthermore, when the connector apparatus 600 is designed in a small size, it is difficult to manually operate the actuator 620 by operator's fingers of ordinary sizes. As a consequence, an operation of mounting the flexible printed wiring board T600 becomes further difficult.

Next, referring to FIG. 4 and subsequent figures, the description will be made as regards a board connector 100 according to an embodiment of the present invention.

Figure 6:
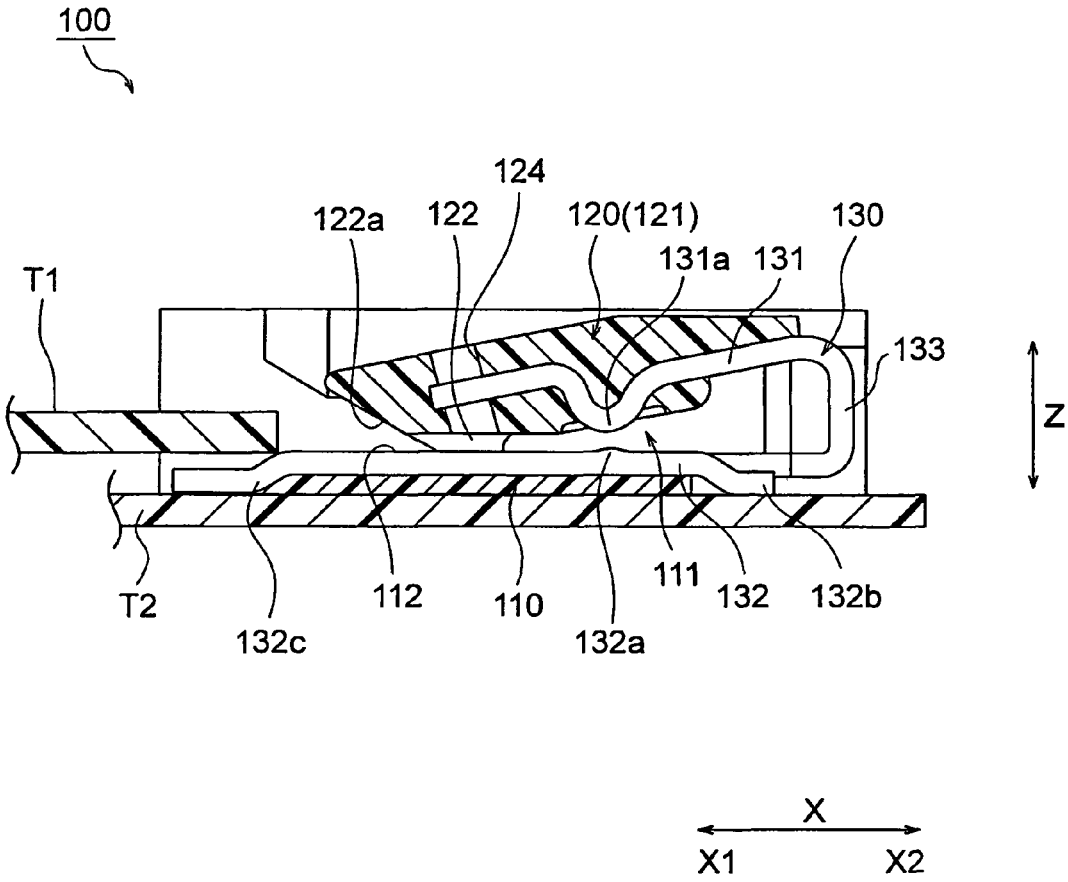
FIG. 6 is a sectional view showing the board connector in a state before the first board is mounted thereto.
Figure 7:
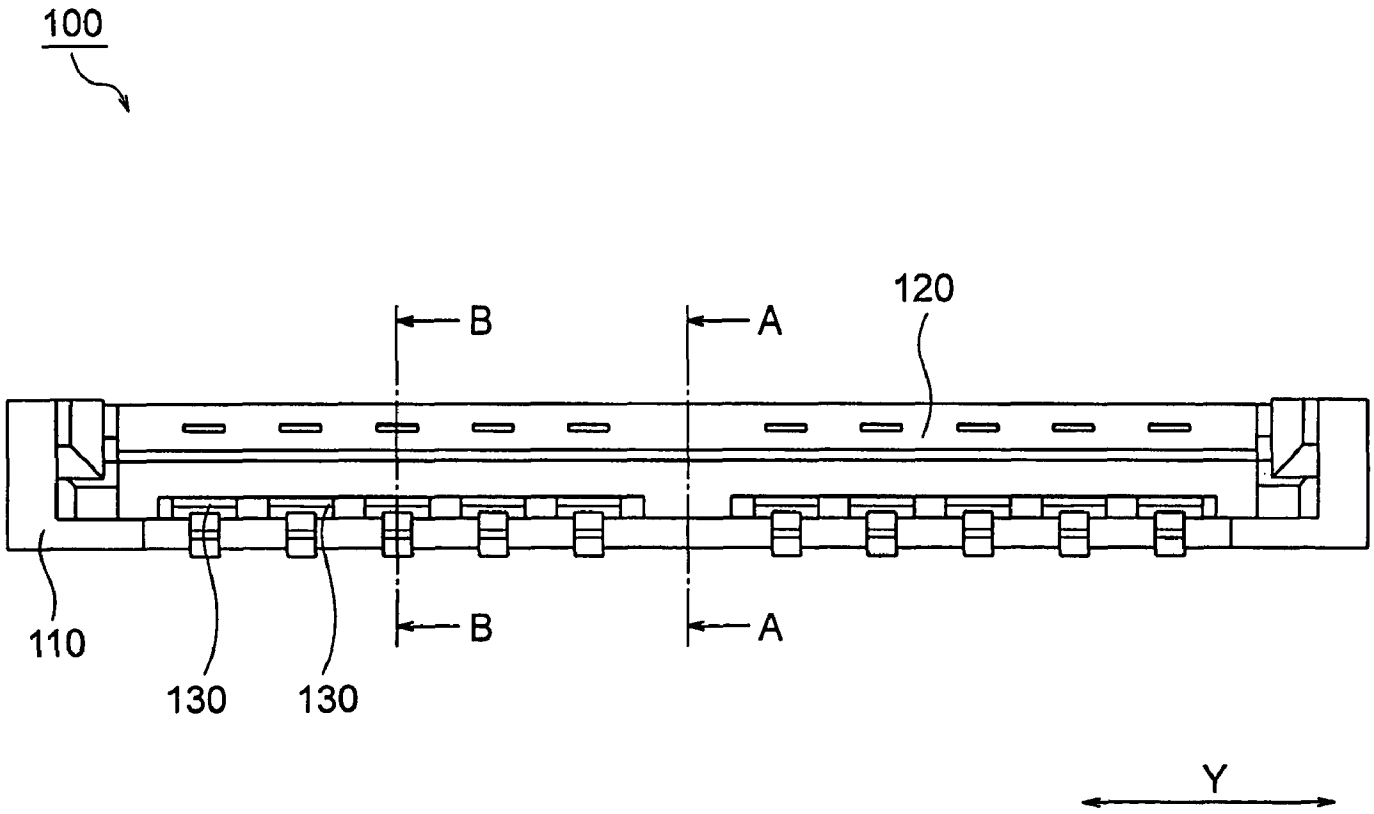
FIG. 7 is a rear view showing the board connector as seen from backward in a board insertion direction.

The board connector 100 is adapted to connect a first board (FPC: Flexible Printed Circuit) T1 as a first connecting object and a second board (printed board) T2 as a second connecting object, as shown in FIG. 6 and so on. The first board T1 is referred to as a board member.

Figure 4:
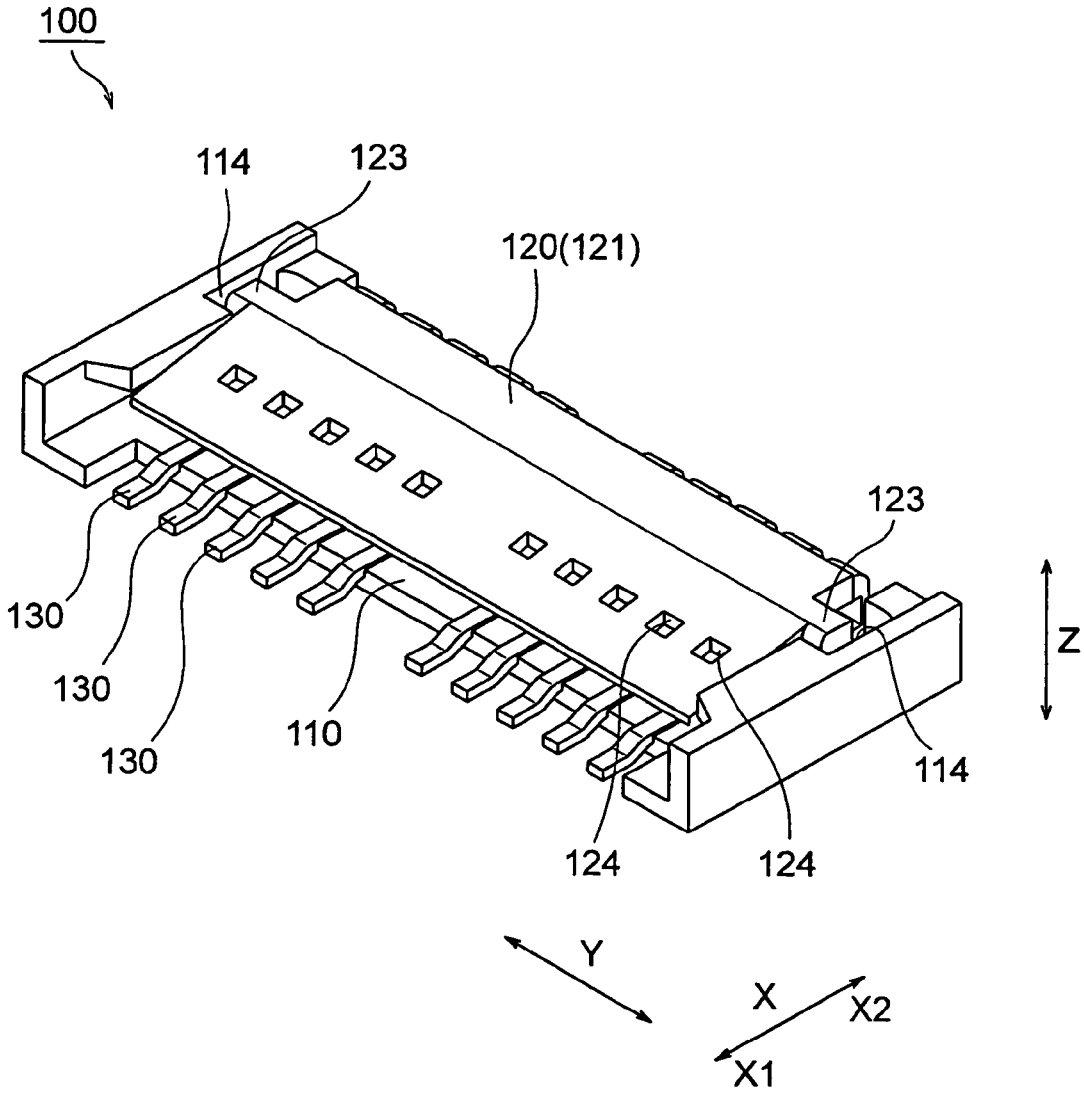
FIG. 4 is a perspective view showing a board connector according to an exemplary embodiment of the present invention.
Figure 5:
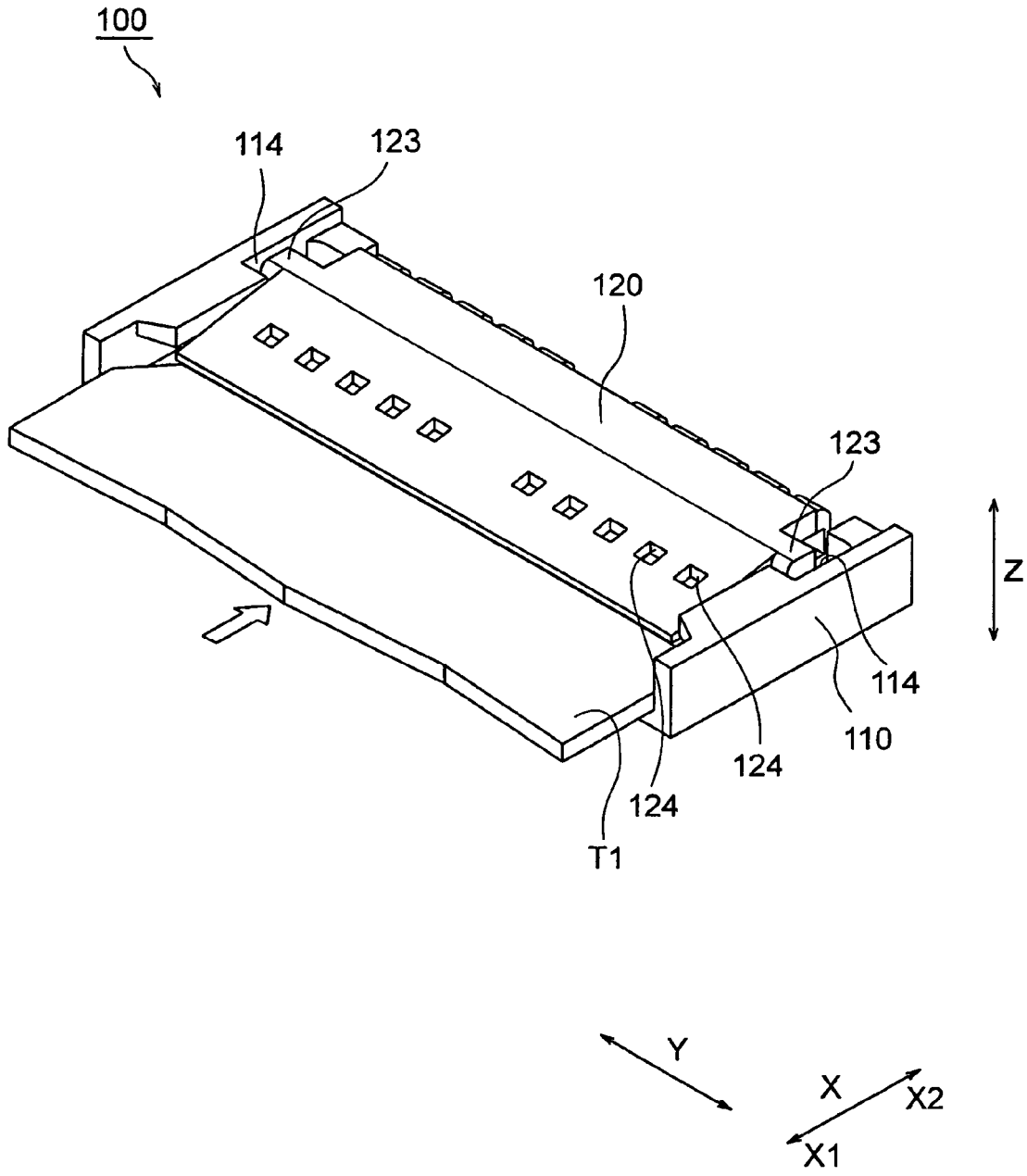
FIG. 5 is a perspective view showing a state where a first board is mounted to the board connector shown in FIG. 4.

The board connector 100 has a housing 110, an actuator 120, and a plurality of contacts 130, as shown in FIGS. 4 and 5. Each of the housing 110 and the actuator 120 is molded of an insulating resin. On the other hand, the contacts 130 are molded of phosphor bronze.

Each of the contacts 130 has a first beam portion 131, a second beam portion 132, and a connecting portion 133 connecting the first and the second beam portions 131 and 132.

Figure 9:
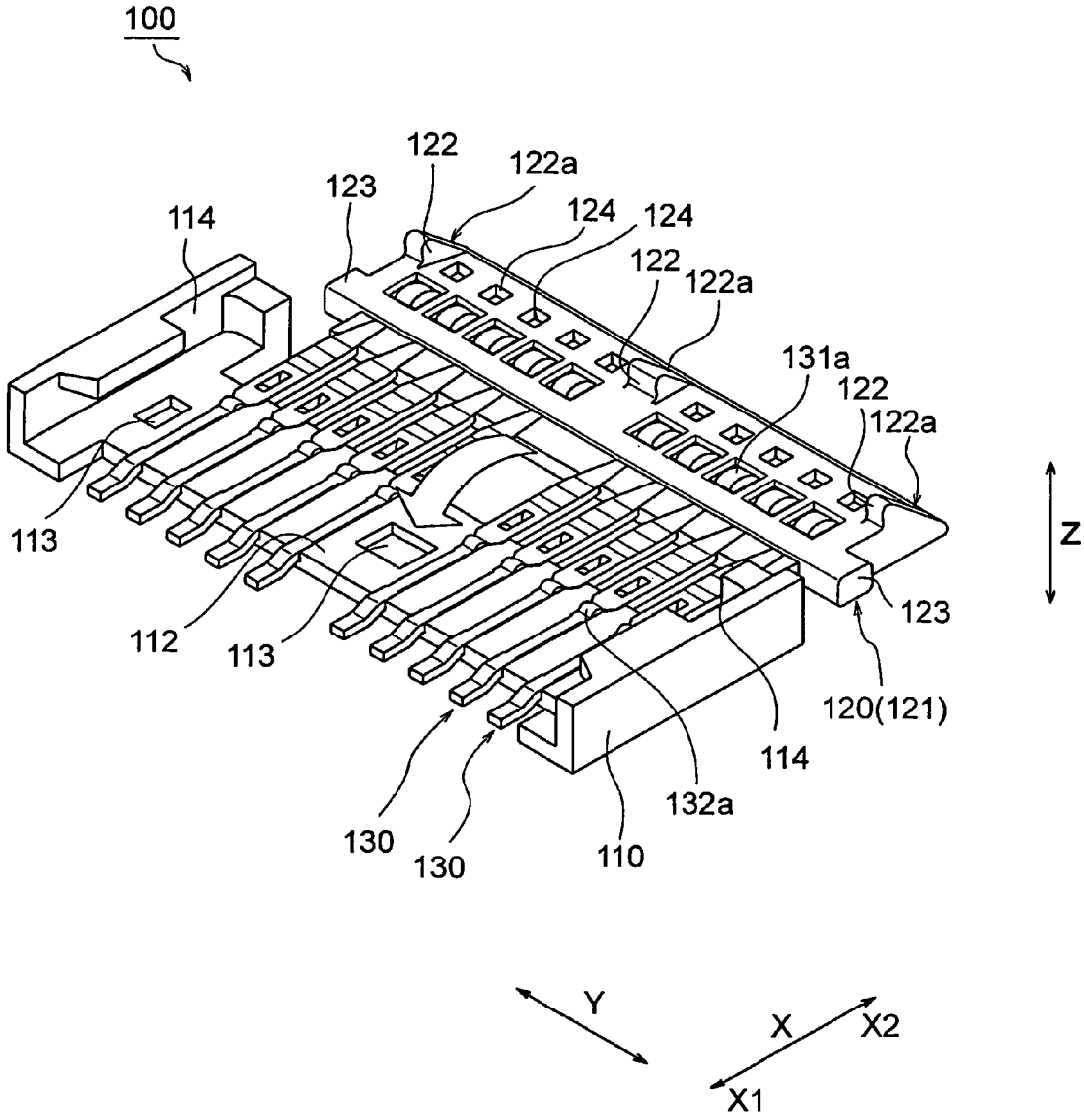
FIG. 9 is a perspective view showing the board connector in the middle of manufacturing.

The housing 110 with the second beam portion 132 buried therein is integral with the first beam portion 131 as shown in FIG. 6 and so on. The housing 110 has a receiving space 111, a board mounting surface 112, a plurality of effort point receiving portions 113, and a pair of concave portions (engaging portions) 114, as shown in FIGS. 4, 6, and 9. Each of the effort point receiving portions 113 will be referred to as a first concave portion.

Figure 10:
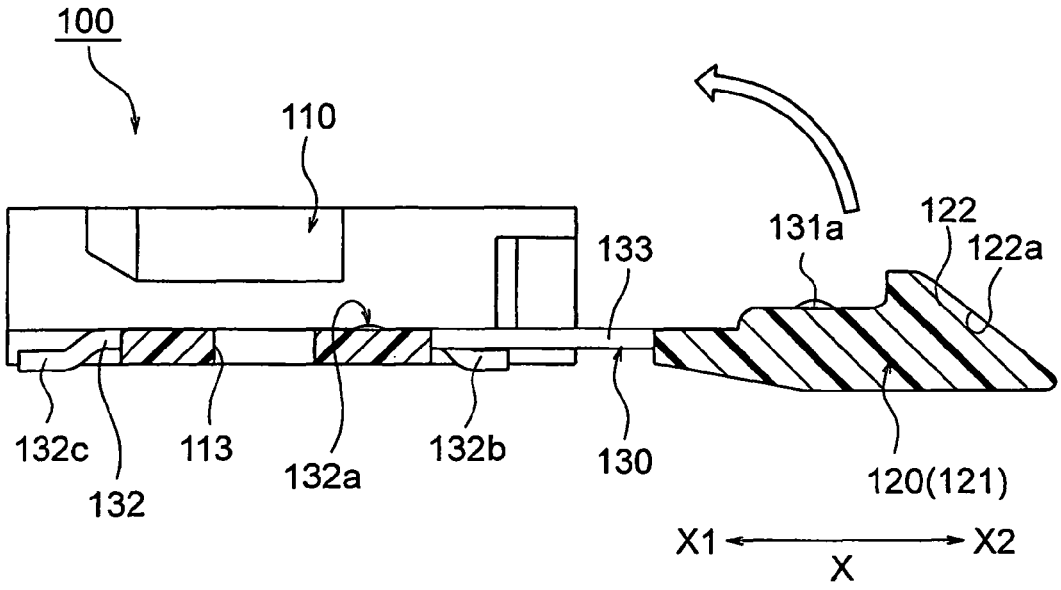
FIG. 10 is a sectional view, taken along a line A-A in FIG. 7, for describing the board connector before the contacts are bent, as seen in a direction depicted by arrows.

The receiving space 111 is a space adapted to receive the first board T1 when the first board T1 is inserted, as shown in FIG. 6 and so on. The board mounting surface 112 functions as a mounting surface for the first board T1, as shown in FIG. 6 and so on. The effort point receiving portions 113 are formed as depressions on the board mounting surface 112 and adapted to receive a plurality of effort point portions 122 of the actuator 120, respectively, as shown in FIGS. 9 and 10 and so on. The concave portions 114 are formed as depressions on both side walls of the housing 110 in a contact width direction Y, respectively, as shown in FIG. 4. Each of the effort point portions 122 will be referred to as a first protruding portion.

The actuator 120 has a main body portion 121, a plurality of effort point portions 122, and a pair of protruding portions (engaging portions) 123, as shown in FIGS. 4, 6, and so on. The main body portion 121 with the first beam portion 131 buried therein is integral with the first beam portion 131, as shown in FIG. 6 and so on.

The effort point portions 122 are arranged at three positions on both sides and at the center of the main body portion 121 in the contact width direction Y and on a frontward side X1 of the main body portion 121 in a board insertion direction X, and are protruded from the main body portion 121 toward the board mounting surface 112, as shown in FIGS. 6, 9, and so on. Each of the effort point portions 122 is arranged on the frontward side X1 in the board insertion direction X with respect to a first clamping portion 131*a* and a second clamping portion 132*a* of each contact 130, as shown in FIG. 6 and so on. Each effort point portion 122 has an inclined surface 122*a* inclined to be closer to the board mounting surface 112 toward a backward side X2 in the board insertion direction X, as shown in FIG. 6 and so on.

The protruding portions 123 are formed on the both sides of the main body portion 121 in the contact width direction Y and protrude outward in the contact width direction Y. The protruding portions 123 are inserted from an upper in the concave portions 114 of the housing 110, respectively, with moving the housing 120 downwardly in a direction Z perpendicular to the board insertion direction X and the contact width direction Y. Therefore, it is readily possible to remove the protruding portions 123 from the concave portions 114 by moving the housing 120 upwardly in the direction Z. Each of the protruding portions 123 will be referred to as a second protruding portion.

Each contact 130 is designed in a so-called normally closed type, as shown in FIG. 6 and so on. Specifically, a distance between the first clamping portion 131*a* and the second clamping portion 132*a*, which will later be described, is set to be smaller than a thickness of the first board T1 in a state where the first board T1 is not inserted. In each contact 130, the first beam portion 131, the second beam portion 132, and the connecting portion 133 are integrally formed, as shown in FIG. 6 and so on.

The most part of the first beam portion 131 is buried inside the main body portion 121 of the actuator 120 to be integral with the main body portion 121, as shown in FIG. 6 and so on. The first beam portion 131 has the first clamping portion 131*a* exposed to the receiving space 111, as shown in FIGS. 6, 9, and so on. The first clamping portion (contact point portion) 131*a* functions as a contact point portion to be brought into contact with a pad (not shown in the figure) formed on the first board T1. The first clamping portion 131*a* is opposed to the second clamping portion 132*a* which will later be described.

In the present embodiment, the first clamping portion 131*a* and the second clamping portion 132*a* are opposed to each other as described above. That is, the first clamping portion 131*a* and the second clamping portion 132*a* in the board insertion direction X correspond or coincide in position with each other. However, the first clamping portion 131*a* and the second clamping portion 132*a* in the board insertion direction X may be shifted in position from each other.

More particularly, the first beam portion 131 has a bent and processed portion near the first clamping portion 131*a*. Both ends of the bent and processed portion of the first clamping portion 131*a* are buried inside the actuator 120 to be surrounded by the actuator 120. Therefore, as long as the actuator 120 is not destroyed, the actuator 120 and the contacts 130 can not separated from each other. Thus, the actuator 120 is completely prevented from coming off from the contacts 130.

The most part of the second beam portion 132 is buried inside the housing 110 to be integral with the housing 110, as shown in FIG. 6 and so on. The second beam portion 132 has the second clamping portion 132*a* exposed to the receiving space 111, a first terminal portion 132*b* formed on the backward side X2 in the board insertion direction X with respect to the second clamping portion 132*a* and soldered to the second board T2, and a second terminal portion 132*c* formed on the frontward side X1 in the board insertion direction X with respect to the second clamping portion 132*a* and soldered to the second board T2, as shown in FIG. 6 and so on.

The connecting portion 133 connects end portions of the first and the second beam portions 131 and 132 on the backward side X2 in the board insertion direction X to each other, as shown in FIG. 6 and so on. The connecting portion 133 biases the first beam portion 131 and the second beam portion 132 so that the first clamping portion 131*a* and the second clamping portion 132*a* approach each other. In other words, the connecting portion 133 generates a clamping force between the first clamping portion 131*a* and the second clamping portion 132*a*. Further, a distance between the connecting portion 133 and each effort point portion 122 is set to be longer than that between the connecting portion 133 and the first clamping portion 131*a*, as shown in FIG. 6 and so on.

Figure 16:
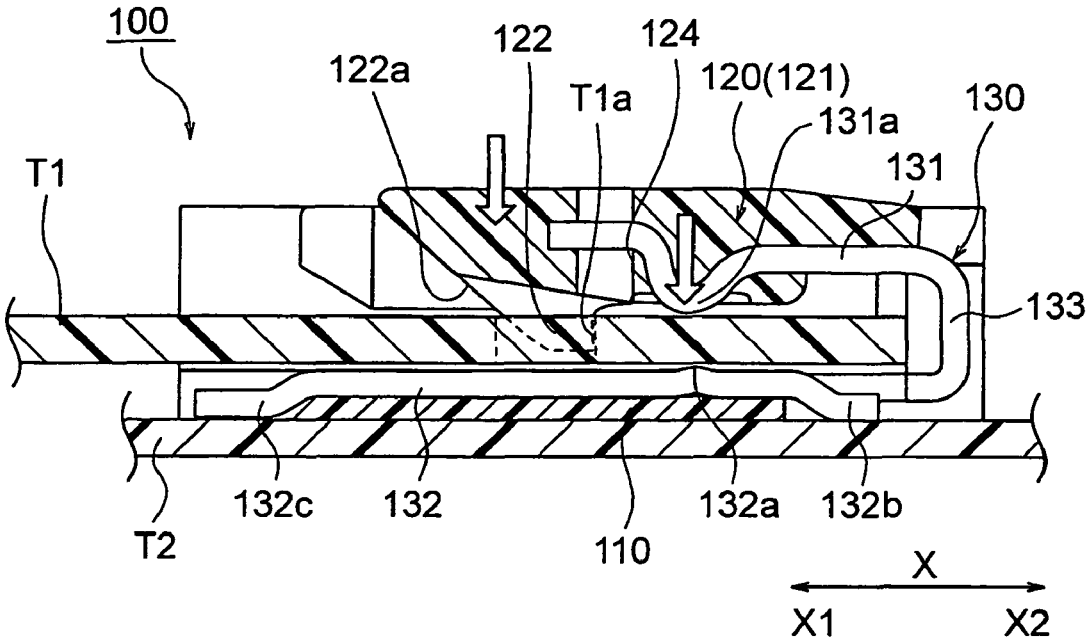
FIG. 16 is a sectional view for describing a state when mounting of the first board is completed.

The first board (FPC) T1 as the first connecting object has a plurality of effort point receiving portions T1*a* which are formed at three positions on both sides and at the center thereof in the contact width direction Y and which are adapted to receive the effort point portions 122 of the actuator 120, respectively, and a plurality of pads (not shown in the figure) to be connected to the first clamping portions 131*a* of the contacts 130, as shown in FIG. 16 and so on.

In the present embodiment, the pads and a conductive pattern are formed only on a front surface of the first board T1, which faces the first clamping portions 131*a*. However, pads and a conductive pattern similar to those on the front surface may be formed also on a rear surface of the first board T1. In this case, the second clamping portions 132*a* are used also as contact points to be brought into contact with the first board T1.

The board connector 100 may be provided with holddowns (not shown in the figure) which are soldered to the second board (printed board) T2 as the second connecting object. By the holddowns, the housing 110 and the second board T2 may be fixed to each other.

Hereinbelow, referring to FIGS. 8 to 13, a manufacturing method of the board connector 100 will be described.

Figure 8:
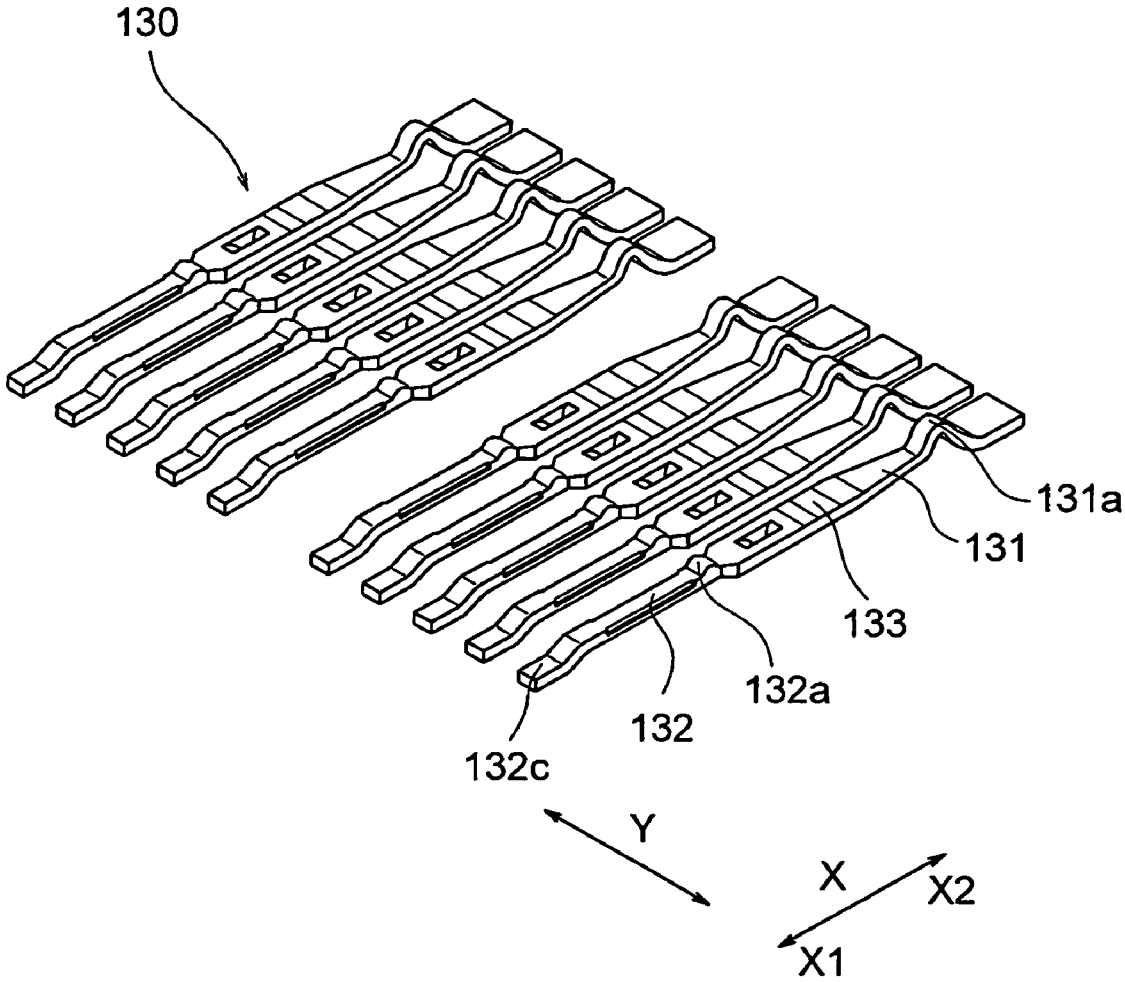
FIG. 8 is a perspective view showing contacts before they are bent.

First, as shown in FIG. 8, a number of contacts 130, in a state where the connecting portions 133 are not bent, are arranged in parallel to one another in a contact wide direction. Each of the first clamping portions 131*a* is formed by bending the first beam portion 131.

Figure 11:
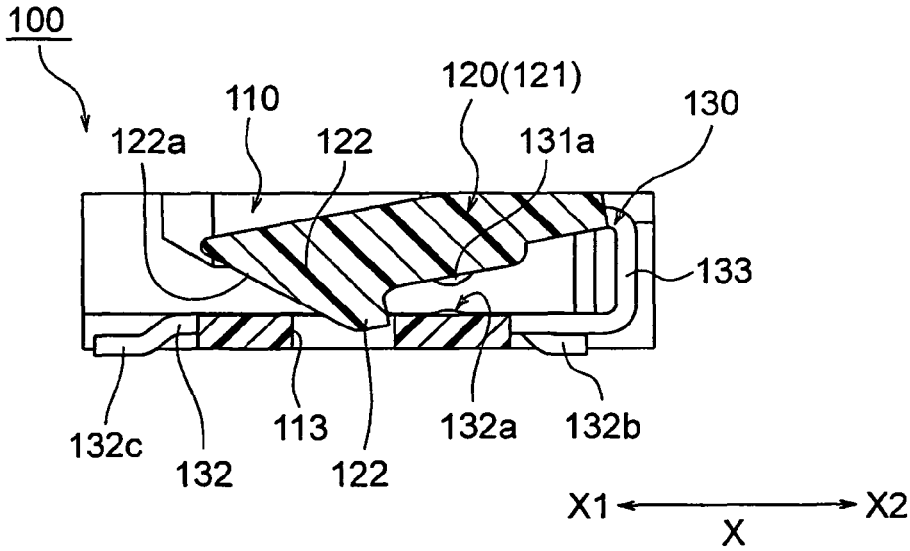
FIG. 11 is a sectional view, taken along the line A-A in FIG. 7, for describing the board connector after the contacts are bent, as seen in the direction depicted by the arrows.
Figure 12:
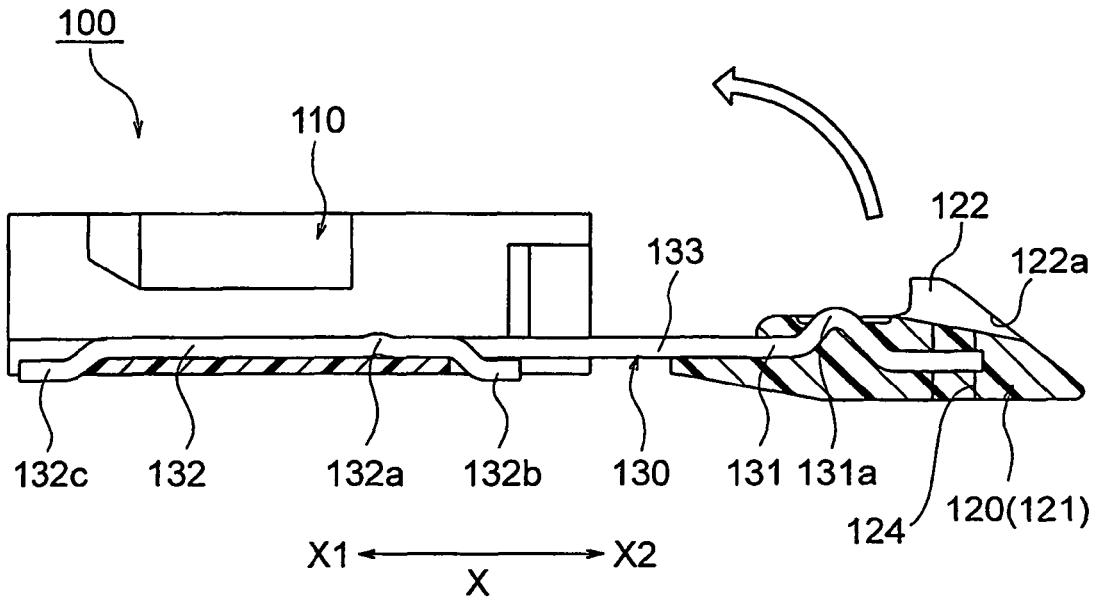
FIG. 12 is a sectional view, taken along a line B-B in FIG. 7, for describing the board connector before the contacts are bent, as seen in a direction depicted by arrows.

Next, as shown in FIGS. 9, 10, and 11, in a state where a plurality of first beam portions 131 are buried inside the actuator 120, the actuator 120 is insert-molded. More particularly, the actuator 120 is formed integral with one end sides or first end sides of the contacts to bury portions of the first end sides inside the actuator 120. Thus, the actuator 120 and the contacts 130 are integrally molded. When the actuator 120 is molded, it is required to suppress movement of the first beam portions 131 with a projection or the like of a molding die. For this purpose, the actuator 120 is provided with a plurality of holes 124 of amount corresponding to contact 130, as shown in FIG. 9 and so on.

Further, in a state where a plurality of second beam portions 132 are buried inside the housing 110, the housing 110 is insert-molded. Thus, the housing 110 and the contacts 130 are integrally molded. More particularly, the housing 110 is formed integral with the other end sides or second end sides of the contacts 130 to bury portions of the second end sides inside the housing 110.

Figure 13:
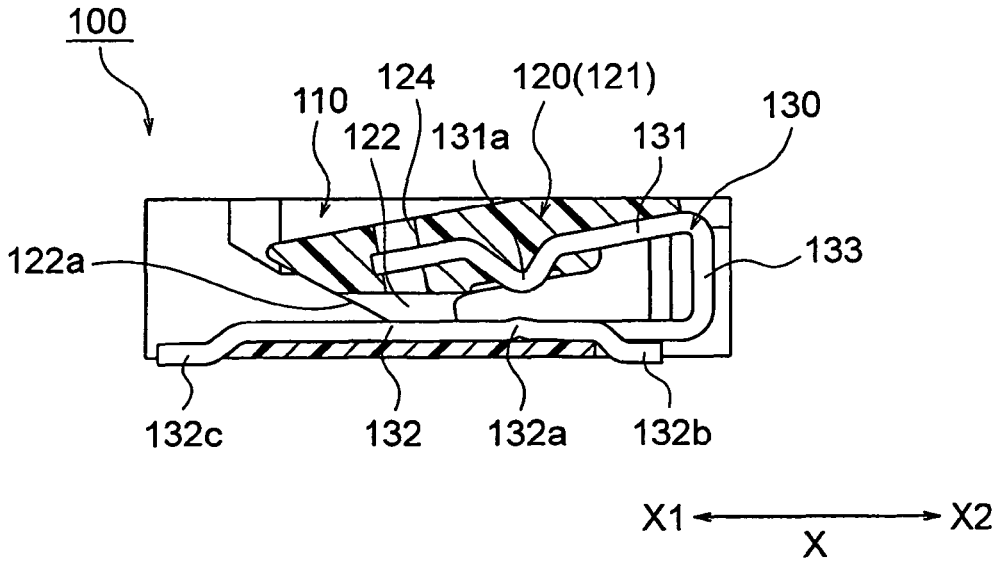
FIG. 13 is a sectional view, taken along the line B-B in FIG. 7, for describing the board connector after the contacts are bent, as seen in a direction depicted by the arrows.

Finally, as shown in FIGS. 9, 11, and 13, each contact 130 is bent at the connecting portion 133. More particularly, the contacts 110 that are integral with one another by the actuator 120 and the housing 110 is collectively folded to face the first end sides and the second end sides to each other.

At this time, the concave portions 114 of the housing 110 and the protruding portions 123 of the actuator 120 function as marks for relative position alignment between the actuator 120 and the housing 110. That is, the contacts 130 are bent so that the protruding portions 123 are positioned in the concave portions 114. In this manner, accurate bending of the contacts 130 can be accomplished.

Simultaneously, the effort point portions 122 and the effort point receiving portions 113 also function as marks for relative position alignment between the actuator 120 and the housing 110.

In the present embodiment, the actuator 120 is provided with the protruding portions (engaging portions) 123 and the housing 110 is provided with the concave portions (engaging portions) 114. The protruding portions 123 and the concave portions 114 are engaged with each other. Alternatively, use may be made of a reverse structure in which the actuator 120 is provided with the concave portions and the housing is provided with the protruding portions.

Hereinbelow, referring to FIGS. 14 to 16, description will be made about a method of mounting or inserting the first board T1 to the board connector 100 and a function of each component upon mounting the first board T1.

Figure 14:
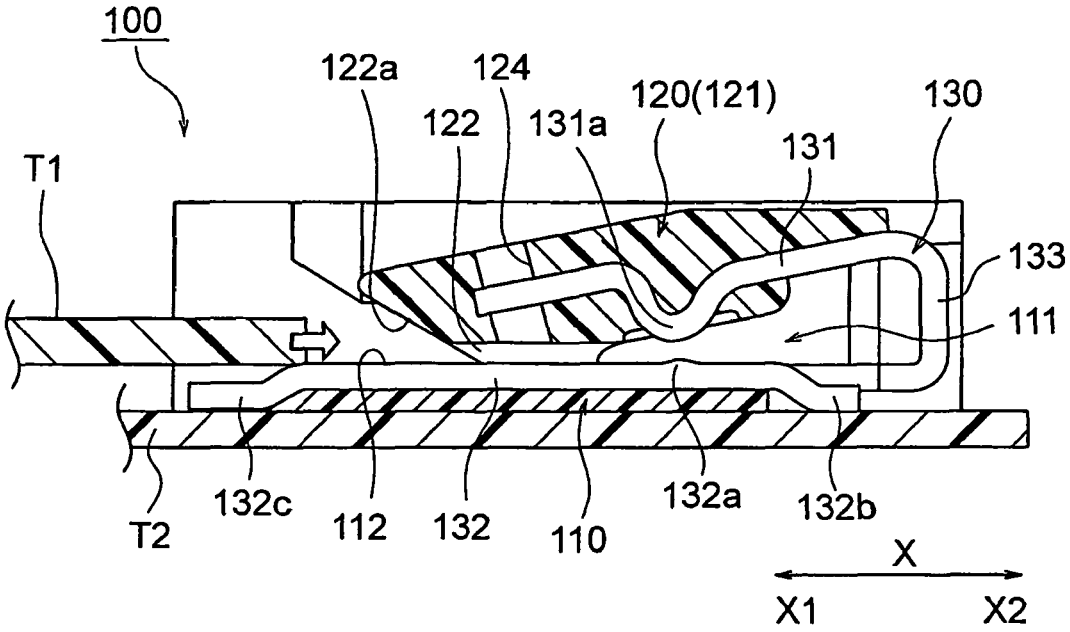
FIG. 14 is a sectional view for describing a state before mounting of the first board.

At first, as shown in FIG. 14, an operator inserts the first board T1 between the housing 110 and the actuator 120 from the frontward side X1 toward the backward side X2 in the board insertion direction X. Each effort point portion 122 of the actuator 120 has the inclined surface 122*a* which is inclined to be closer to the board mounting surface 112 toward the backward side X2 in the board insertion direction X. Therefore, as shown in FIG. 15, by insertion of the first board T1, the effort point portions 122 of the actuator 120 are pushed up in a direction away from the board mounting surface 112.

Figure 15:
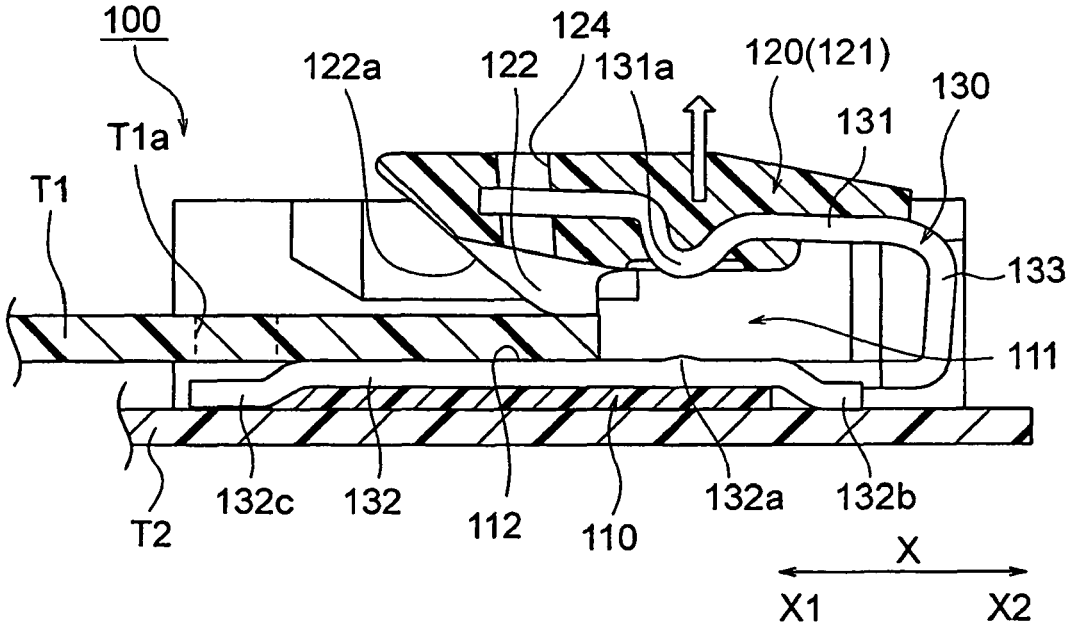
FIG. 15 is a sectional view for describing a state in the middle of mounting of the first board.

In this event, as shown in FIG. 15, the first beam portion 131 integral with the actuator 120 is pushed up together with the actuator 120 in the direction away from the board mounting surface 112. At this time, the connecting portion 133 is elastically deformed. As a result, as shown in FIG. 15, the distance between the first clamping portion 131*a* and the second clamping portion 132*a* is increased to become greater than the thickness of the first board T1.

Next, the first board T1 is further pushed by the operator toward the backward side X2 in the board insertion direction X and enters between the first clamping portion 131*a* and the second clamping portion 132*a*.

Next, the first board T1 is still further pushed by the operator toward the backward side X2 in the board insertion direction X. Then, as shown in FIG. 16, the effort point receiving portions Tla of the first board T1 coincide in position with the effort point portions 122 of the actuator 120, respectively.

In this event, the effort point portions 122 of the actuator 120 lose a support by the first board T1. Therefore, the connecting portion 133 of each contact 130 elastically returns and the actuator 120 is moved in a direction in which the effort point portions 122 of the actuator 120 approach the board mounting surface 112. As a result, as shown in FIG. 16, the distance between the first clamping portion 131*a* and the second clamping portion 132*a* of each contact 130 is going to return to a normal distance, that is, to become smaller than the thickness of the first board T1.

Then, the first clamping portion 131*a* and the second clamping portion 132*a* clamp the first board T1 to establish connection between the first clamping portion 131*a* and the pad (not shown in the figure) of the first board T1. At the same time, the effort point portions 122 of the actuator 120 enter into the effort point receiving portions T1*a* of the first board T1 to be received therein. Thus, the first board T1 is positioned with respect to the board connector 100 and prevented from dropping out from the board connector 100.

Hereinbelow, referring to FIG. 17, a method of removing the first board T1 from the board connector 100 will be described.

First, the operator inserts a jig M having an end portion M1 of a wedge shape between the effort point portions 122 of the actuator 120 and the first board T1. As a consequence, the effort point portions 122 of the actuator 120 are pushed up in a direction away from the board mounting surface 112.

Figure 17:
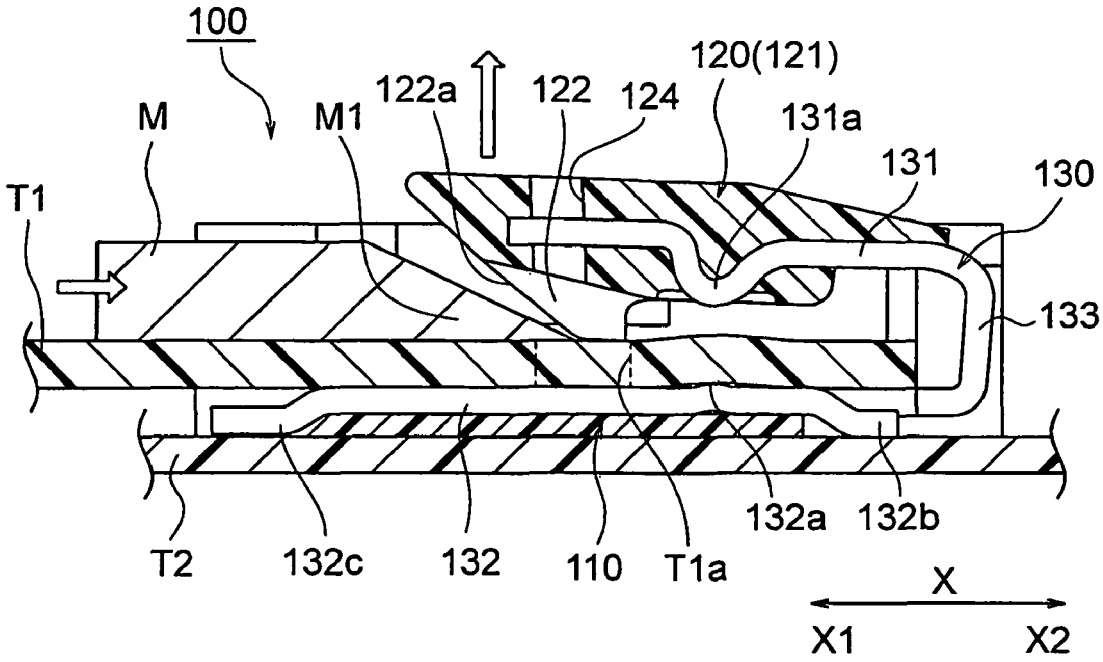
FIG. 17 is a sectional view for describing a state in the middle of removal of the first board.

In this event, as shown in FIG. 17, the first beam portion 131 integral with the actuator 120 is pushed up together with the actuator 120 in the direction away from the board mounting surface 112. At this time, the connecting portion 133 is elastically deformed. As a result, the distance between the first clamping portion 131*a* and the second clamping portion 132*a* is increased to become greater than the thickness of the first board T1. Then, the operator can easily extract the first board T1 from between the first clamping portion 131*a* and the second clamping portion 132*a*.

Even if the first board T1 is engaged with (caught by) the actuator 120 when the first board T1 is extracted, the protruding portions 123 are engaged with the concave portions 114 to thereby prevent movement of the actuator 120 together with the first board T1 toward the frontward side X1 in the board insertion direction X. Thus, it is possible to prevent deformation of the contacts 130 due to the movement of the actuator 120.

As described above, the protruding portions 123 can readily be removed from the concave portions 114 by moving the housing 120 upwardly in the direction Z. This means that the actuator 130 and the housing 120 do not directly make a hinged connection therebetween. More particularly, the actuator is not directly hinged to the housing 120 but is mechanically connected to the housing 120 through the contacts 130.

The board connector 100 thus obtained has a structure in which the distance between the first clamping portion 131*a* and the second clamping portion 132*a* of each contact 130 is increased by using the first board T1 inserted into the board connector 100. Therefore, an additional operation of manipulating the actuator 120 is not required separately from the operation of inserting the first board T1. Thus, an operation of mounting the first board T1 can be accomplished by the single operation step of inserting the first board T1 to thereby remarkably reduce a workload on the operation of mounting the first board T1.

Further, by insertion of the first board T1, the distance between the first clamping portion 131*a* and the second clamping portion 132*a* is automatically increased only by a given required amount. Therefore, even if the first board T1 is manufactured thicker within a tolerance range, it is possible to avoid excessive frictional movement of the first board T1 with respect to the first clamping portion 131*a* and the second clamping portion 132*a*. Thus, the first board T1 can be prevented from being damaged.

Furthermore, the board connector 100 has a structure in which the actuator 120 is moved by insertion of the first board T1 without requiring manual operation of the actuator 120. Accordingly, the movement of the actuator 120 during insertion of the first board T1 is restricted to a minimum level allowing the first board T1 to be inserted between the first clamping portion 131*a* and the second clamping portion 132*a*. In addition, it is possible to prevent an excessive force from acting on the actuator 120 and the like as in a case where the actuator 120 is manually operated. Therefore, a breakage of the actuator 120 and the like can be prevented.

Furthermore, as described above, a manual operation of the actuator 120 is not required. Therefore, even if the board connector 100 as a whole is designed in a small size, it is possible to prevent an unfavorable situation in the conventional connector apparatus in which the actuator is manually operated, i.e, a situation where the actuator 120 is difficult to be manually operated by operator's fingers of ordinary sizes. Thus, the operation of mounting the first board T1 can easily be accomplished.

As shown in FIG. 13, the distance between the connecting portion 133 and the effort point portion 122 in the board insertion direction X is set to be longer than that between the connecting portion 133 and the first clamping portion 131*a*. With this structure, it is possible to reduce a required insertion force of the first board T1, thereby improving a workability. In addition, it is possible to avoid excessive physical contact between the first board T1 and the effort point portions 122 of the actuator 120 during insertion of the first board T1, thereby preventing the first board T1 from being damaged.

This structure can avoid a sliding between the actuator 120 and the contacts 130 when insert the first board T1 thereby to decrease or avoid an abrasion powder caused by the sliding. Therefore, contact reliability of the connector can be improved. Moreover, an accurate driving operation between the actuator 120 and the first beam portion 131 can be maintained.

The actuator 120 and the contacts 130 are integrally molded and the housing 110 and the contacts 130 are integrally molded. With this structure, an operation of fixing a number of contacts 130 to the actuator 120 and to the housing 110 becomes unnecessary. Further, it is possible to treat the contacts 130, the actuator 120, and the housing 110 as a single element or unit. Therefore, a manufacturing load can be reduced. Furthermore, it is possible to prevent separation between the actuator 120 and the contacts 130 and separation between the housing 110 and the contacts 130. Therefore, product reliability can be improved.

A clamping force between the first clamping portion 131*a* and the second clamping portion 132*a* is generated by the connecting portion 133 which is formed by bending a metal material. Therefore, not only a structure of each contact 130 can be simplified but also the board connector 100 can be manufactured only by molding the actuator 120 and the housing 110 integrally with the contacts 130, and thereafter bending the contacts 130. Thus, a manufacturing load of the board connector 100 can remarkably be reduced.

As an interlocking mechanism for interlocking a pushing movement of the effort point portions 122 and widening of the distance between the first and the second clamping portions 131*a* and 132*a* by insertion of the first board T1, the present embodiment employs a simple structure in which the actuator 120 and the first beam portion 131 of each contact 130 are integral with each other. Therefore, it is possible to suppress occurrence of an operation failure of the board connector 100 due to a defect of the interlocking mechanism.

The housing 110 and the first board T1 have the effort point receiving portions 113 and T1*a* for receiving the effort point portions 122 of the actuator 120, respectively. Therefore, it is possible to reduce a thickness of the whole board connector 100. In addition, it is possible to properly position the first board T1 with respect to the board connector 100 and to prevent the first board T1 from dropping out of the board connector 100. As a consequence, connection between the pads (not shown in the figure) of the first board T1 and the first clamping portions 131*a* of the contacts 130 can reliably be maintained.

Each of the effort point portions 122 of the actuator 120 has the inclined surface 122*a* inclined to be closer to the board mounting surface 112 toward the backward side X2 in the board insertion direction X. Therefore, the effort point portions 122 can easily be pushed up by a small insertion force of the first board T1. Thus, it is possible to prevent excessive physical contact between the first board T1 and the effort point portions 122 and to accomplish a smooth insertion operation of the first board T1.

The connecting portion 133 biases the first beam portion 131 and the second beam portion 132 so that the first clamping portion 131*a* and the second clamping portion 132*a* approach each other. Therefore, it is possible to prevent the actuator 120 from undesiredly moving and rising with respect to the housing 110 after completion of mounting or before mounting of the first board T1.

The foregoing embodiment has been described assuming that the first board is a FPC (Flexible Printed Circuit). However, the first board may be any connecting object of a flat plate-like shape, for example, a FFC (Flexible Flat Cable).

Next, the description will be directed to effects of the above-mentioned exemplary embodiment.

It is possible to provide a board connector capable of easily accomplishing a mounting operation of a flexible printed wiring board (a board member) by a single operation step of inserting the board, of preventing a damage of the board during insertion of the board, and of preventing a breakage of an actuator and the like.

The board connector has the structure in which the distance between the clamping portions of each contact is increased by using the board member as the connecting object inserted into the board connector. Therefore, an additional operation of manipulating the actuator is not required separately from the operation of inserting the board member. Thus, the operation of mounting the board member can be accomplished by the single operation step of inserting the board member to thereby remarkably reduce the workload on the operation of mounting the board member.

By insertion of the board member, the distance between the clamping portions of each contact is automatically increased only by a given required amount. Accordingly, even if the board member as the connecting object is manufactured thicker within a tolerance range, it is possible to avoid excessive frictional movement of the board member with respect to the clamping portions of each contact. Thus, the board member can be prevented from being damaged.

Further, the board connector has a structure in which the actuator is moved by insertion of the board member without requiring manual operation of the actuator. Accordingly, the movement of the actuator during insertion of the board member is restricted to a minimum level. In addition, it is possible to prevent an excessive force from acting on the actuator and the like as in a case where the actuator is manually operated. Therefore, a breakage of the actuator and the like can be prevented.

Furthermore, as described above, a manual operation of the actuator is not required. Therefore, even if the board connector as a whole is designed in a small size, it is possible to prevent an unfavorable situation in the conventional connector apparatus in which the actuator is manually operated, i.e., a situation where the actuator is difficult to be manually operated by operator's fingers of ordinary sizes. Thus, the operation of mounting the board member can easily be accomplished.

As the interlocking mechanism for interlocking the pushing movement of the effort point portions and widening of the distance between the clamping portions by insertion of the board member, the simple structure is employed in which the actuator and the beam portion of each contact are integral with each other. Therefore, it is possible to suppress occurrence of an operation failure of the board connector due to a defect of the interlocking mechanism.

This invention is not limited to the above-mentioned embodiment and part or the whole thereof can also be described as the following supplementary notes but is not limited thereto.

(Supplementary Note 1)

A board connector 100 for connecting a board member T1 inserted thereto in a board insertion direction X, the board connector comprising:

a contact 130 which comprises a first and a second beam portion 131 and 132;

a housing 110 which holds the contact; and an actuator 120 which is integral with the first beam portion;

wherein the first and the second beam portions comprise a first and a second clamping portion 131*a* and 132*a*, respectively, for clamping therebetween the board member, and wherein the actuator comprises an effort point portion 122 which is formed forward with respect to the first clamping portion in the board insertion direction and which is pushed and moved by the board member when the board member is inserted into the board connector.

(Supplementary Note 2)

The board connector according to supplementary note 1, wherein the contact further comprises a connecting portion 133 connecting the first and the second beam portions to each other.

(Supplementary Note 3)

The board connector according to supplementary note 2, wherein the first and the second clamping portions are opposite to each other in a direction intersecting the board insertion direction, and the connecting portion biases the first and the second beam portions to approach the first and the second clamping portions each other.

(Supplementary Note 4)

The board connector according to supplementary note 2 or 3, wherein the connecting portion, the first clamping portion, and the effort point portion are arranged in the board insertion direction, and a distance between the effort point portion and the connecting portion is set to be longer than a distance between the first clamping portion and the connecting portion.

(Supplementary Note 5)

The board connector according to supplementary notes 1 through 4, wherein the actuator is molded integrally with the contact.

(Supplementary Note 6)

The board connector according to supplementary notes 1 through 5, wherein the housing is molded integrally with the contact.

(Supplementary Note 7)

The board connector according to supplementary notes 1 through 6, wherein the first and the second clamping portions are formed by bending the first and the second beam portions, respectively.

(Supplementary Note 8)

The board connector according to supplementary notes 1 through 7, wherein the housing comprises an effort point receiving portion 113 receiving the effort point portion, and the effort point portion has an inclined surface 122*a* which is inclined with respect to the board insertion direction and which guides an insertion of the board member into the board connector.

(Supplementary Note 9)

The board connector according to supplementary notes 1 through 8, wherein the actuator and the housing have engaging portions 114 and 123, respectively, which are engaged with each other to restrict movement of the actuator with respect to the housing toward a frontward side in the board insertion direction.

(Supplementary Note 10)

The board connector according to supplementary note 9, wherein the engaging portions comprises:

a concave portion 114 which is formed to one of the actuator and the housing; and a protruding portion 123 which is formed to another of the actuator and the housing and is insertable to the concave portion in a direction intersecting the board insertion direction.

(Supplementary Note 11)

A method of manufacturing a board connector, comprising:

preparing a plurality of contacts;

arranging the contacts in parallel in a contact wide direction;

actuator-forming an actuator integral with first end sides of the contacts to bury portions of the first end sides inside the actuator;

housing-forming a housing integral with second end sides of the contacts to bury portions of the second end sides inside the housing; and collectively folding the contacts that are integral with one another by the actuator and the housing, to face the first end sides and the second end sides to each other.

(Supplementary Note 12)

The method according to supplementary note 11, wherein the actuator-forming step comprises forming a first protruding portion to the actuator to protrude in the contact wide direction, and the collectively folding step comprises facing the first protruding portion to the housing.

(Supplementary Note 13)

The method according to supplementary note 12, wherein the housing-forming step comprises forming a first concave portion to the housing, and the collectively folding step comprises inserting the first protruding portion to the first concave portion.

(Supplementary Note 14)

The method according to any one of supplementary notes 11-13, wherein the actuator-forming step comprises forming a second protruding portion to the actuator to protrude in the contact wide direction, the housing-forming step comprises forming a second concave portion to the housing, and the collectively folding step comprises engaging the second protruding portion with the second concave portion.

(Supplementary Note 15)

The method according to any one of supplementary notes 11-13, wherein the actuator-forming step comprises forming a concave portion to the actuator, the housing-forming step comprises forming a protruding portion to the housing, and the collectively folding step comprises engaging the protruding portion with the concave portion.

(Supplementary Note 16)

The method according to any one of supplementary notes 11-15, further comprising folding the first end side of each contact after the preparing step to produce a bent and processed portion, and the actuator-forming step comprises forming the actuator integral with both ends of the bent and processed portion to bury the both ends inside the actuator.

(Supplementary Note 17)

The method according to supplementary note 16, wherein the actuator-forming step comprises forming the actuator integral with the first end side of each contact to expose a top portion of the bent and processed portion, and the collectively folding step comprises facing the top portion to the housing.

(Supplementary Note 18)

The method according to any one of supplementary notes 11-17, wherein the actuator-forming step comprises:

forming the actuator integral with the first end sides of the contacts in a condition where the first end side of each contact is held from its outside; and forming a plurality of holes to the actuator in correspondence of the contacts.

(Supplementary Note 19)

The method according to any one of supplementary notes 11-18, wherein the housing-forming step comprises forming the housing integral with the second end sides of the contacts to expose a portion of the second end side of each contact, and the collectively folding step comprises facing the portion of the second end side of each contact to the actuator.

(Supplementary Note 20)

The method according to any one of supplementary notes 11-19, wherein the contacts are made of metal and each of the housing and the actuator is made of plastic material.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

What is claimed is:

1. A board connector for connecting a board member inserted thereto in a board insertion direction, the board connector comprising:

a contact which comprises a first and a second beam portion;

a housing which holds the contact; and an actuator which is integral with the first beam portion;

wherein the first and the second beam portions comprise a first and a second clamping portion, respectively, for clamping therebetween the board member, and wherein the actuator comprises an effort point portion which is formed forward with respect to the first clamping portion in the board insertion direction and which is pushed and moved by the board member when the board member is inserted into the board connector.

2. The board connector according to claim 1, wherein the actuator is molded integrally with the contact.

3. The board connector according to claim 1, wherein the housing is molded integrally with the contact.

4. The board connector according to claim 1, wherein the first and the second clamping portions are formed by bending the first and the second beam portions, respectively.

5. The board connector according to claim 1, wherein the housing comprises an effort point receiving portion receiving the effort point portion, and the effort point portion has an inclined surface which is inclined with respect to the board insertion direction and which guides an insertion of the board member into the board connector.

6. The board connector according to claim 1, wherein the actuator and the housing have engaging portions, respectively, which are engaged with each other to restrict movement of the actuator with respect to the housing toward a frontward side in the board insertion direction.

7. The board connector according to claim 6, wherein the engaging portions comprises:

a concave portion which is formed to one of the actuator and the housing; and a protruding portion which is formed to another of the actuator and the housing and is insertable to the concave portion in a direction intersecting the board insertion direction.

8. The board connector according to claim 1, wherein the contact further comprises a connecting portion connecting the first and the second beam portions to each other.

9. The board connector according to claim 8, wherein the first and the second clamping portions are opposite to each other in a direction intersecting the board insertion direction, and the connecting portion biases the first and the second beam portions to approach the first and the second clamping portions each other.

10. The board connector according to claim 8, wherein the connecting portion, the first clamping portion, and the effort point portion are arranged in the board insertion direction, and a distance between the effort point portion and the connecting portion is set to be longer than a distance between the first clamping portion and the connecting portion.

11. A method of manufacturing a board connector, comprising:

preparing a plurality of contacts;

arranging the contacts in parallel in a contact wide direction;

actuator-forming an actuator integral with first end sides of the contacts to bury portions of the first end sides inside the actuator;

housing-forming a housing integral with second end sides of the contacts to bury portions of the second end sides inside the housing; and collectively folding the contacts that are integral with one another by the actuator and the housing, to face the first end sides and the second end sides to each other.

12. The method according to claim 11, wherein the actuator-forming step comprises forming a second protruding portion to the actuator to protrude in the contact wide direction, the housing-forming step comprises forming a second concave portion to the housing, and the collectively folding step comprises engaging the second protruding portion with the second concave portion.

13. The method according to claim 11, wherein the actuator-forming step comprises forming a concave portion to the actuator, the housing-forming step comprises forming a protruding portion to the housing, and the collectively folding step comprises engaging the protruding portion with the concave portion.

14. The method according to claim 11, wherein the actuator-forming step comprises:

forming the actuator integral with the first end sides of the contacts in a condition where the first end side of each contact is held from its outside; and forming a plurality of holes to the actuator in correspondence of the contacts.

15. The method according to claim 11, wherein the housing-forming step comprises forming the housing integral with the second end sides of the contacts to expose a portion of the second end side of each contact, and the collectively folding step comprises facing the portion of the second end side of each contact to the actuator.

16. The method according to claim 11, wherein the contacts are made of metal and each of the housing and the actuator is made of plastic material.

17. The method according to claim 11, wherein the actuator-forming step comprises forming a first protruding portion to the actuator to protrude in the contact wide direction, and the collectively folding step comprises facing the first protruding portion to the housing.

18. The method according to claim 17, wherein the housing-forming step comprises forming a first concave portion to the housing, and the collectively folding step comprises inserting the first protruding portion to the first concave portion.

19. The method according to claim 11, further comprising folding the first end side of each contact after the preparing step to produce a bent and processed portion, and the actuator-forming step comprises forming the actuator integral with both ends of the bent and processed portion to bury the both ends inside the actuator.

20. The method according to claim 19, wherein the actuator-forming step comprises forming the actuator integral with the first end side of each contact to expose a top portion of the bent and processed portion, and the collectively folding step comprises facing the top portion to the housing.

* * * * *